US005568770A

United States Patent [19]

Ito et al.

[11] Patent Number: 5,568,770

[45] Date of Patent: Oct. 29, 1996

[54] TANK TRANSPORTATION SYSTEM AND PRODUCTION UTILIZING THE SAME

[75] Inventors: Hidekazu Ito, Okayama; Ryoichi Morimoto, Akaiwa-gun; Hidemitsu Miura, Kurashiki, all of Japan

[73] Assignee: Kuraray Engineering Co., Ltd., Kurashiki, Japan

[21] Appl. No.: 436,729

[22] Filed: May 8, 1995

[30] Foreign Application Priority Data

May 25, 1994 [JP] Japan ..... 6-136400
Dec. 27, 1994 [JP] Japan ..... 6-340519

[51] Int. Cl.[6] ..... B61J 3/00

[52] U.S. Cl. ..... 104/88.01; 104/91

[58] Field of Search ..... 104/89, 91, 98, 104/88.01, 88.02; 198/349.5, 349.6, 465.3

[56] References Cited

U.S. PATENT DOCUMENTS

| | | | |
|---|---|---|---|
| 2,884,871 | 5/1959 | Mazzola et al. | 104/98 X |
| 4,289,076 | 9/1981 | Miller | 104/89 X |
| 4,836,111 | 6/1989 | Kaufmann | 104/89 |
| 4,874,281 | 10/1989 | Bergerioux et al. | 198/349.5 X |
| 5,085,059 | 2/1992 | Grigoli et al. | 198/465.3 X |
| 5,335,601 | 8/1994 | Matsumoto et al. | 104/88.01 |

FOREIGN PATENT DOCUMENTS

| | | | |
|---|---|---|---|
| 60-186572 | 9/1985 | Japan . | |
| 2-16170 | 1/1990 | Japan . | |
| 3-178755 | 8/1991 | Japan . | |
| 3293294 | 12/1991 | Japan | 104/89 |
| 5-23578 | 2/1993 | Japan . | |
| 6-40329 | 2/1994 | Japan . | |

*Primary Examiner*—Robert J. Oberleitner
*Assistant Examiner*—Kevin D. Rutherford
*Attorney, Agent, or Firm*—Oblon, Spivak, McClelland, Maier & Neustadt, P.C.

[57] ABSTRACT

A tank transportation system comprises rails, stations, and a conveying truck moving on the rails between the stations under computer control. The conveying truck suspends a tank, which performs predetermined operations at the station, delivers and/or receives it to and from the station, and transports it to other stations in order. The system is used preferably for producing flowable composites.

4 Claims, 4 Drawing Sheets

TANK TRANSPORTATION SYSTEM AND PRODUCTION UTILIZING THE SAME

BACKGROUND OF THE INVENTION

1. Field of the Invention

The present invention relates to a tank transportation system and a production method utilizing the same. More particularly, the present invention relates to a tank transportation system, which comprises suspending a tank from a conveying truck movable On rails under computer control, delivering and/or receiving the tank to and from stations provided at one or both sides of the rails, permitting the tank to carry out predetermined operations at the stations, and moving the tank successively from one of the stations to the next, and to a production method utilizing the same. In particular, the tank transportation system of the present invention is suitable for the production of flowable composites such as paint, which directs toward a multiproduct-small quantity production.

2. Description of the Prior Art

Flowable composites such as paints have been generally produced by using equipment with fixed tanks, pipes and other apparatus and conducting each of the processes such as feeding raw materials, agitation and filling products. In general, the tanks are used while being suspended from and fixed to a second floor, and a first floor is used as a vast space required to set incidental facilities for supplying and receiving the empty cans, and storing products, filling products, delivering and shipping the filled cans, and like purposes. In recent years, multiproduct-small-quantity production is going to prevail in the fields of producing, for example, fine chemicals such as perfumes and various resins such as paints. In order to accommodate to that direction by using the above mentioned fixed-type equipment, the equipment with small tanks equipped with many pipes and valves should become a multi-line type and complicated as a whole, which results in extremely inefficient and less flexible production. Since severe accuracy in avoiding contamination is generally required to guarantee good quality, the tanks, pipes etc. must be washed thoroughly, which requires much labor so that an operator's load becomes larger. Furthermore, the washing is not likely to be complete and the productivity is not high at all. As mentioned above, it is in the present situation that there is much trouble in conducting multiproduct-small-quantity production through the conventional fixed-type equipment.

To improve the fixed-type equipment for the above multiproduct-small-quantity production, Japanese Patent Application Laid-open No. 186572/1985 discloses a method for producing paints which comprises placing a tank for preparing paints on an unmanned tank-carrying vehicle, and permitting the tank to move between stations, each of which corresponds to each of production processes, under computer-Aided remote control.

Japanese Patent Application Laird-open No. 40329/1994 discloses a system adapted to multiproduct small-quantity production, comprising an unmanned tank-carrying vehicle having a lid opening/closing mechanism and another tank-carrying vehicle loaded on the above unmanned tank-carrying vehicle to carry the tank. This production system, moving the tank itself for production, to avoid the aforementioned problems, is considered to be a very rational production method.

Although these methods are considered more suitable for multiproduct-small-quantity production compared with the fixed-type equipment, they need a vast space on the first floor for the unmanned tank-carrying vehicles to travel around, and for the stations and other auxiliary facilities. This has been pointed out as a problem when these methods are introduced, because this tends to offset the following advantage of the aforementioned fixed-type equipment system. The system, in which the tanks are usually suspend from and fixed to the second floor and a filling equipment is placed on the first floor just under the second floor, rationally secures a vast space used for placing incidental facilities to supply, receive, store and fill empty cans, and to send and ship filled cans. Namely, these methods require an separate area to set these incidental facilities an hence need more space for both building area and site than the conventional method, which is not economical and makes stiff the organic relationship with the incidental facilities.

In order to solve the above problems, it has been attempted to provide the filling equipment and other incidental facilities on the first floor and provide a floor space for an unmanned tank-carrying vehicle to travel around, its stations and other auxiliary facilities on the second floor. However, this system completely separates various facilities and working processes on the first floor from those on the second floor by the presence of the floor of the second floor. Furthermore, this system requires the provision of an additional tank-operating floor or the third floor to carry out a prescribed job required for the tank, which causes a problem in view of a working efficiency. Naturally, the above situation is not necessarily limited to the relationship between the first and second floors and the same holds true for the relationship between the floor for the unmanned tank-carrying vehicle to travel on and its upper and lower floors. In the explanations above and below, a limited expression of "the first floor" or "the second floor" is used merely for better understanding, and is not necessarily limited to the literal interpretation.

On the other hand, as a method where an unmanned tank-carrying vehicle does not travel on the floor of the first floor, Japanese Patent Application Laid-open No. 16170/1990 discloses a method for producing paints, which comprises moving a tank consecutively, by means of overhead traveling cranes. In this method, however, although the unmanned tank-carrying vehicle is not required to travel around on the floor of the first floor, stations and other auxiliary facilities still occupy a large area on the floor of the first floor so that the floor is not used effectively. Furthermore, the cranes move in a whole space including a ceiling and must move around avoiding various facilities such as piping to transport the tank, which causes a problem again from the viewpoint of working efficiency. In addition to the above, since the crane is attached to the ceiling together with other belongings, the building structure must be strongly-built, which results in a higher building cost.

As another method to decrease the occupied area of the first floor, Japanese Patent Application Laid-open No. 178755/1991 discloses what is known as a stacker crane method, which comprises moving a tank vertically to carry out each process work. This method also has problems that the first floor is still fully occupied and that working processes are separated from each other over all stages completely due to traveling of the stacker crane. Besides, since transportation capacity of the stacker crane often becomes a bottleneck, this method is not necessarily considered to be rational from the viewpoint of production efficiency and to be suitable for the process for producing paints where a series of consecutive operations are mostly conducted on the same flat plane.

As still another method to decrease the occupied area of the first floor, on which the unmanned tank-carrying vehicle does not travel around, Japanese Patent Application Laid-open No. 23578/1993 discloses a method for transporting a vessel, which comprises preparing a reaction vessel and its detachable heating jacket independently, placing them on a multi-stage type structure, enabling the vessel to move optionally with a stacker crane and/or an unmanned tank-carrying vehicle horizontally on each stage or vertically between the upper and the lower stages. This method has the same problem as in the stacker crane method that working processes are separated from each other completely due to traveling of the stacker crane on all stages. Like the above overhead traveling crane method, this method also has a problem in the working efficiency with respect to the relationship between the traveling of the crane and the position of the vessel.

Among the above mentioned methods, in the methods where the tank is placed on the unmanned tank-carrying vehicle, the center of gravity of the tan is maintained at a high level so that the stability becomes poor and the contents of the tank tend to be shaken to a large extent. In addition, when the tanks with different capacities are used mixedly, it is necessary that the length of the tank-legs be adjusted to keep the tanks at a certain height and to secure workability on the working stage. Then, it becomes almost impossible to transport the tanks stably, because too long legs are required for small-capacity tanks. For the same reason, there are various practical restrictions, such as incapability of optionally setting the height of the working stage.

SUMMARY OF THE INVENTION

It is an object of the present invention to provide a rational tank transportation system highly adaptable to various production processes and suitable for multiproduct-small-quantity production, where working processes are not separated by a stage floor or means for carrying the tank and operates related to the tank are readily carried out from the upper or lower floor and which is adaptable even to an operation involving a plurality of the tanks having different capacities, is not restricted with respect to the height of working stages, and can efficiently use the space of the floor for setting incidental facilities. Another object of the invention is to provide for the production method utilizing the above tank transportation system.

The present invention provides for a tank transportation system, which at least comprising rails, stations provided at one or both side of the rails and a conveying truck movable on the rails, said truck being capable of suspending the tank and moving on the rails following the procedure determined by computer programs, delivering the tank to one of the stations and receiving the tank which, while being suspended and held by the station, has performed a predetermined operation at the station, and transporting the tank from the station to another in order. The present invention also provides for a method for producing flowable composites utilizing the above tank transportation system.

BRIEF DESCRIPTION OF THE DRAWINGS

A more complete appreciation of the invention and many of the attendant advantages thereof will be readily obtained as the same become better understood by reference to the following detailed description, when considered in connection with the accompanying drawings, wherein.

DETAILED DESCRIPTION OF THE PREFERRED EMBODIMENTS

Figure 1:
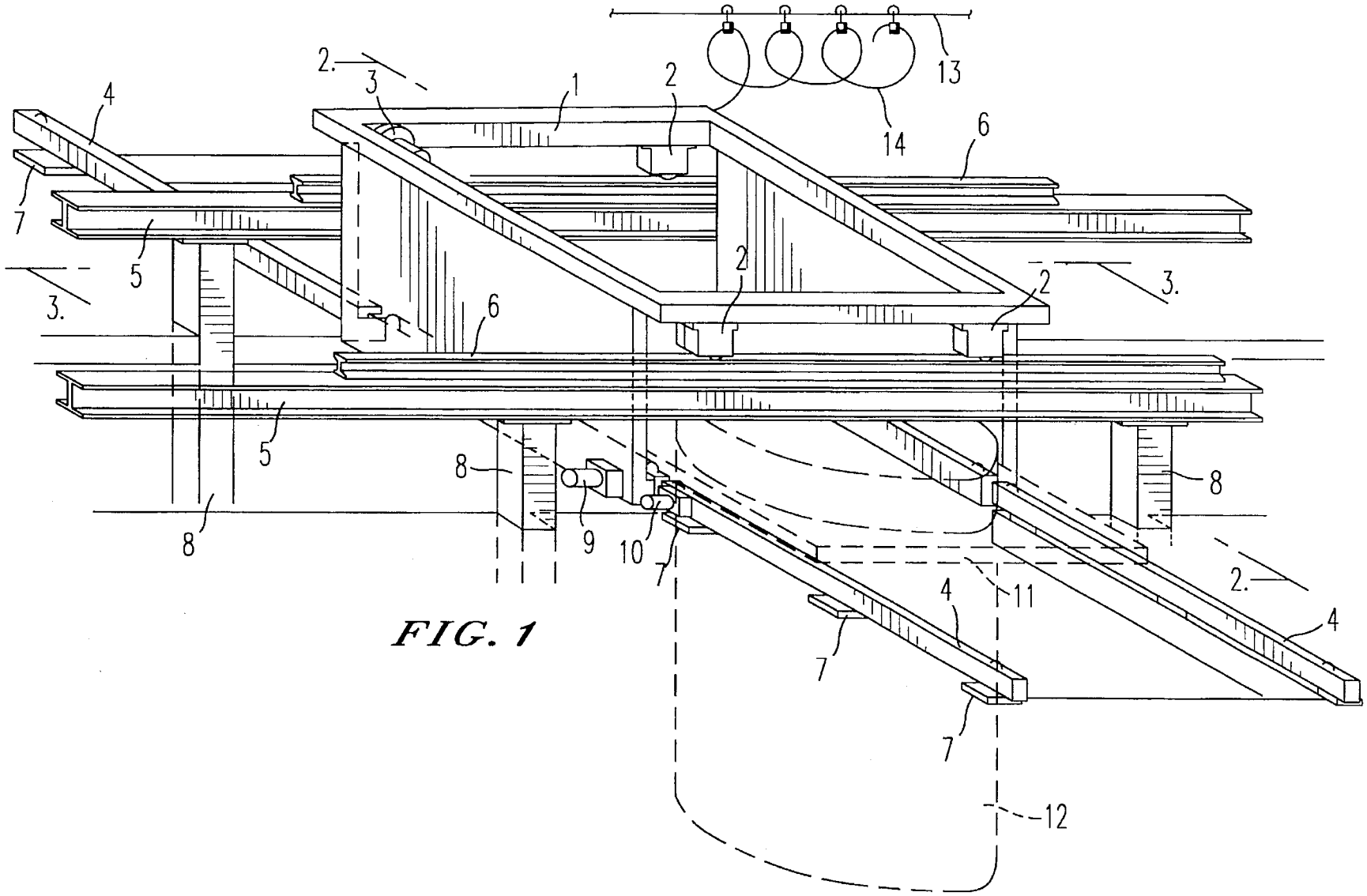
FIG. 1 is a perspective view of a preferred embodiment of the tank transportation system of the present invention.

An example of the tank transportation system of the present invention will be explained below in accordance with drawings. FIG. 1 is a perspective view of the tank transportation system of the present invention, FIG. 2 is a cross-sectional view taken along the line A—A of FIG. 1 and FIG. 3 is a cross-sectional view taken along the line B—B of FIG. 1.

Figure 2:
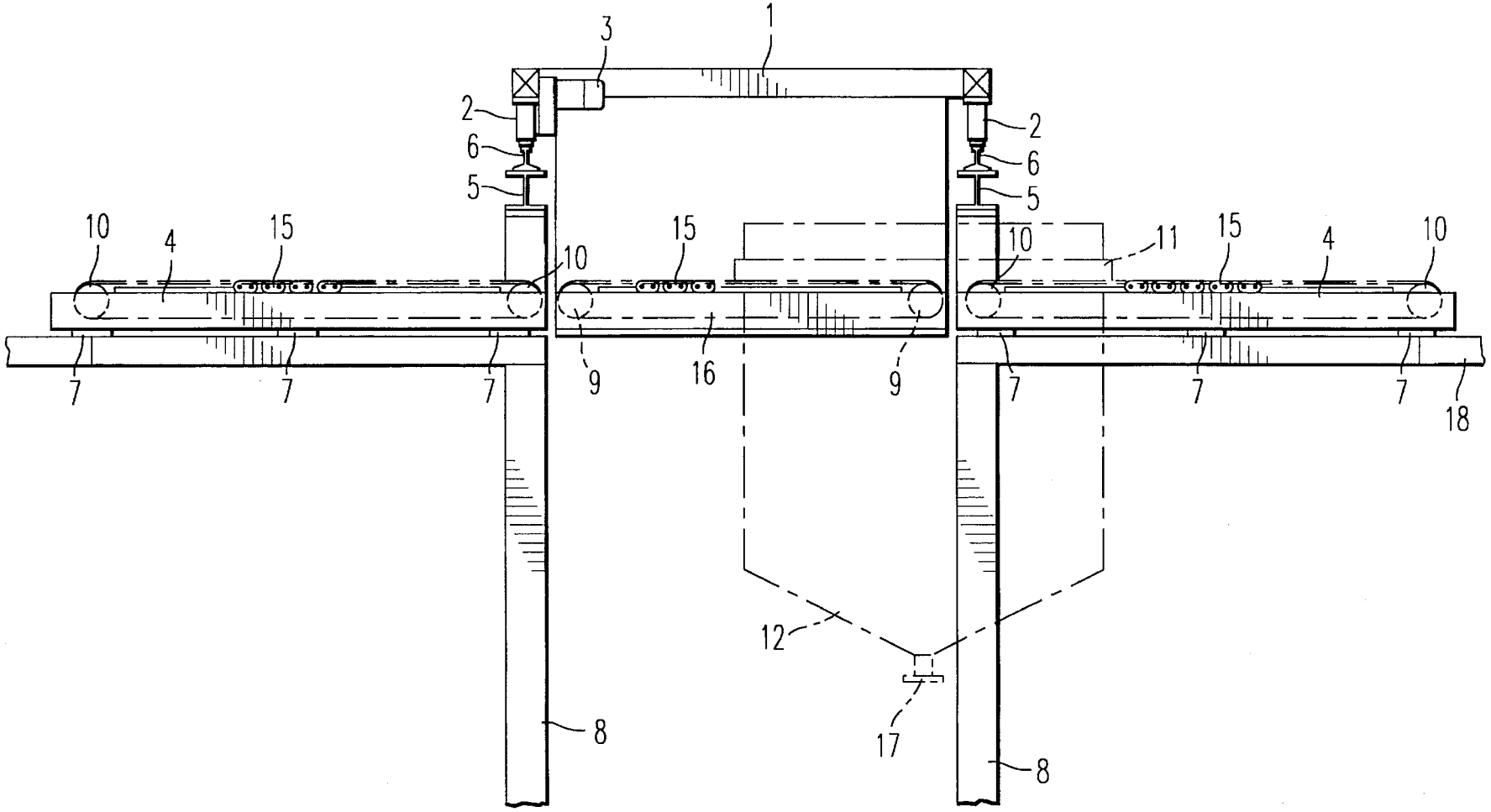
FIG. 2 is a cross-sectional view taken along line A—A of FIG 1.
Figure 3:
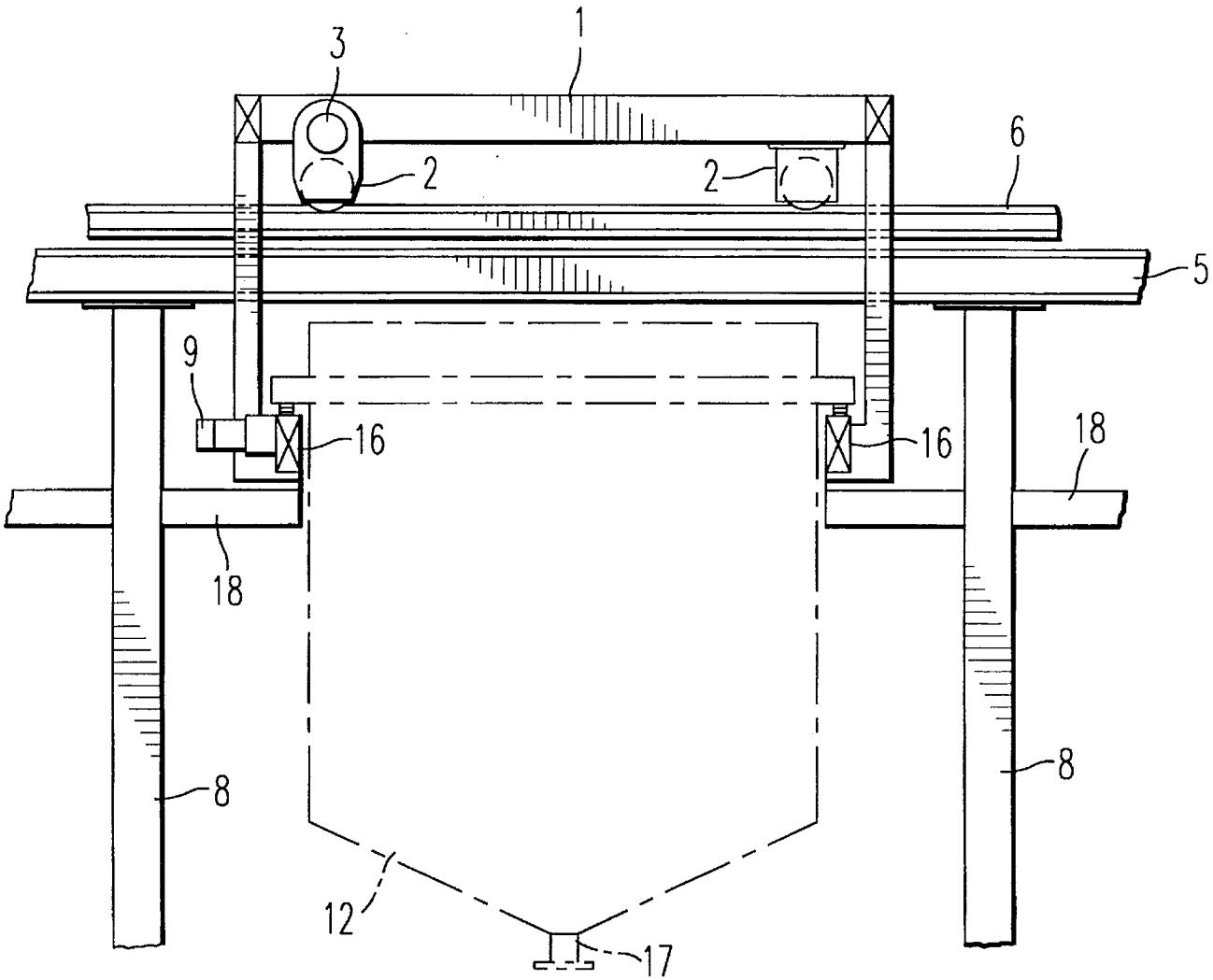
FIG. 3 is a cross-sectional view taken on the line B—B of FIG. 1.

In FIG. 1 through FIG. 3, 1 is a conveying truck, which suspends a tank and moves on rails, 2 is a wheel, and 3 is a driving motor the wheels. In FIG. 1 through FIG. 3, the conveying truck having four wheels is illustrated, but the type of wheels or the conveying truck is not necessarily restricted to the type shown in the FIGS. and whatever can move on the rail, for example a monorail type, may be used. The conveying truck moves on rails 6, which are set on a H-steel 5 fixed with a strut 8. The conveying truck 1 is controlled by a computer in accordance with a present program and moves while accompanied by cabtire/cable 14 connected to messenger wire 13, on the rails.

4 is a chain conveyor for a station to receive and/or deliver the tank 12 at the station. The tank 12 is integrated with a tank-supporting base 11 to support the tank and is suspended from the conveying truck by fixing the tank-supporting base 11 to the upper part of a chain conveyor 16 attached to the conveying truck. It is more preferable to suspend the tank 12 in such a manner that the top of the tank 12 is positioned below the rail 6, because the tank 12 can be delivered and/or received more quickly at the stations.

It is preferably recommended that the conveying truck 1 be equipped with various sensors and safety devices to detect obstacles during moving, to prevent drifting of the tank and like purposes. According to the present invention, compared to other tank 12 transportation systems, the tank can be moved more safely with less shaking of the contents therein because the tank moves while being suspended from the conveying truck. In the FIGURES, a covering device over the tank 12 is not shown, but such device may be provided on the conveying truck to protect the contents from contamination with dust etc. or the tank 12 may have a lid, if necessary.

Each chain conveyor is driven by driving motor 10 or 9 for delivering and/or receiving the tank at the station. 17 represents an outlet port to take a product or semi-product (hereinafter merely referred to as "product") out of the tank 12, which is usually equipped with an automatic valve. 7 indicates a component part to fix the chain conveyor 4 for the station and 18 is a stage floor. When the difference of heights between the tank supporting base of the conveying truck and the station must be adjusted, a suitable adjusting device may be added to, for example, the conveying truck.

Figure 4:
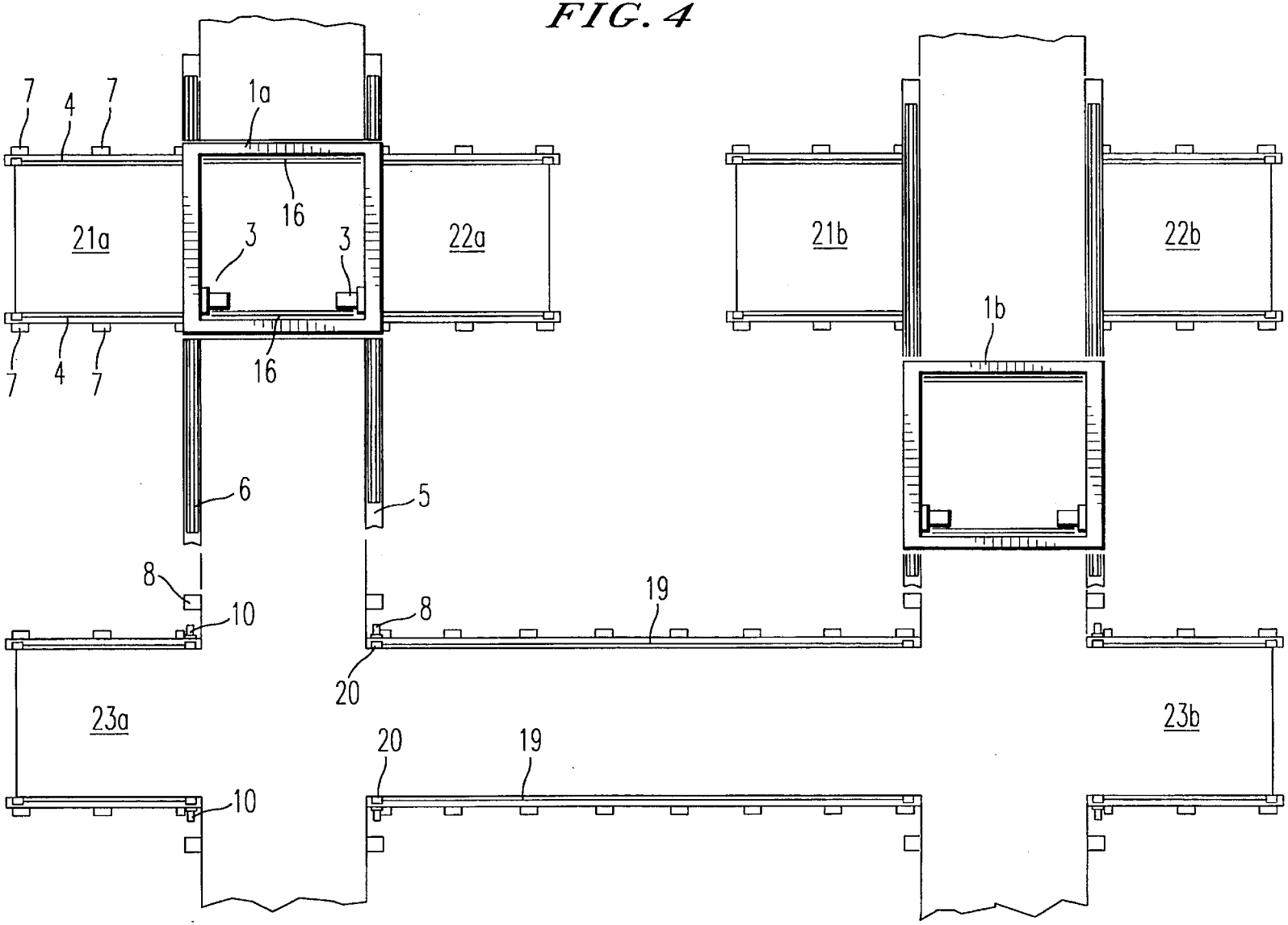
FIG. 4 is a plan of an example of a production process which uses the tank transportation system of the present invention.

One of embodiments for using the tank transportation system of the present invention for a production-line will be explained below by reference to FIG. 4. FIG. 4 shows an example of a production system having two production lines, wherein a and b indicate line a and line b, respectively.

1*a* and 1*b* are the conveying trucks for line a and line b, respectively, which move on the rails under computer control. Their speeds may be set optionally and are usually in a range of about 5 to about 30 m/min. The conveying trucks travel through the stations 21*a*, 21*b*, 22*a*, 22*b*, 23*a* and 23*b* etc., and at each of the stations the tanks are transferred to and received from the station. The tanks are, while being suspended from and held by the station, subjected to the predetermined working processes such as receiving raw materials, agitation of the contents, discharging the product out of the tank and washing the inside. Naturally, if necessary, some of the above processes may be carried out halfway between the stations. The tanks may be employed adequately, at he stations, also for purposes such as storage of the product and waiting, other than those for the working operations described above.

The tanks are delivered to and/or received from the station by driving the chain conveyor 16 attached to the conveying truck and the chain conveyor 4 for the station by driving motors 9 and 10 respectively At the stations, the predetermined operations such as feeding raw materials, agitation of the contents, discharging the product out of the tank, washing of the inside, storage of the products and waiting are done. The conveying truck suspends the tank, having completed the predetermined operations, and moves to the next station.

It is more preferable, to obtain a higher working efficiency, that the production lines be connected with each other through a passage. The passage part may be usable when the processes are conducted continuously in a horizontal direction. In FIG. 4, 19 is a passage chain conveyor used for the passage part. The passage chain conveyor 4 is essentially the same as the conveyor for station but is usually longer than the conveyor for station. The chain conveyors described so far may be replaced by other conveying systems answering the intended purpose such as a belt conveyor and a roller conveyor. Also, a conveying system as disclosed in Japanese Patent Application Laid-open No. 186572/1985, which comprises an unmanned tank-carrying vehicle stations both having rolling devices, and the vehicle having, housed therein, an operation device for delivery and/or receipt of the tank, may be applied to the present invention.

The tank transportation system of the present invention is easily applicable to production of paints merely by assigning each of the stations above to each processes such as receiving raw materials, agitation, discharging products, washing and waiting.

Although the case having two production lines is explained above, it is needless to say that the tank transportation system and production method utilizing the same of the present invention are applicable even to production with lines having more than two production lines. The rails may be set in any of shapes such as a linear shape merely along the production line, H shape, U shape and/or O shape so as to fit the production processes.

According to the present invention, since the conveying truck does not move on the floor of the first floor, the floor can be provided with various related incidental facilities. The conveying truck moves on rails, suspending the tank in such a manner that a suitable working space is retained between the bottom of the tank and the floor of the first floor and that movements of men and materials are not disturbed. The stations are set near above the floor of the upper floor, and suspend and retain the tank. The rails are set at an upper space over the floor of the upper floor. Since the rails can be set at a relatively lower position on the upper floor, auxiliary facilities can be provided transversely through the space above the rails. Thus, passages for operators can be provided transversely over the rails so that separation of the processes can be avoided. The tanks, which are suspended above the floor to receive working operations, have the advantage that the tanks having substantially different capacities an be operated mixedly and easily without addition of any special system or without lowering of workability.

The tank transportation system of the present invention can be used not only in plane and multiple arrangements on the same floor but also in similar arrangements on a plurality of floors. In the latter case, it is preferable to provide a transportation device capable of moving vertically between at least a pair of stations set on different floors, which permits the tank to move between the different floors and permits the production line to have more freedom. Naturally, the vertically movable transportation device can be set for the tank transportation system having only a single floor, i.e. not multiple floors.

A production line arranged through multiple floors can improve the production efficiency in such a manner that a raw material feeding process, a raw material preparing process, an intermediate preparing process and a product preparing process are arranged from the top floor to the bottom in order, whereby gravity can be used for transportation of the contents of the tank. Usually, the tank capacity required varies according to process and increases gradually as the process proceeds from the raw material feeding toward the product preparation. Since each of the processes has its own characteristic, tanks and the auxiliary facilities at each floor are constituted as a group having common specifications. As a result, the tank is transported principally on the same plane and rarely moved vertically.

When the tank transportation system is set on each floor of a multiple-floor plant and applied to the production system mentioned above, the tanks can be transported independently on the floors, which affords more freedom of production schedule and more efficient production. On the other hand, as mentioned above, although the method using a stacker crane has been proposed for production utilizing a tank transportation system involving multiple-floor, its ability of transportation often becomes a bottleneck. Considering the above mentioned characteristics of production line, it is obvious that the present invention is more excellent.

When the tank transportation system of the present invention is applied to a multiple-floor production process, each tank is suspended and retained from the conveying truck or the station of each of the floors so that the contents in a tank suspended from the upper floor can, by suitably connecting the two tanks, be transferred to another tank prepared on the lower floor. According to the system of the present invention, such operation related to both upper and lower stages can be performed in extremely high workability without separating the facilities on both floors by the floor of the upper floor.

When the tank transportation system of the present invention is applied to various production processes, the changeover of product type can be readily conducted without contamination due to connection work of fixed-pipes and like works, which improves freedom of the production processes. Accordingly, it becomes possible to carry out more suitably multiproduct small-quantity production of flowable composites , e.g. paints, ink, lubricants, adhesives, surfactants, resins, foods, light sensitive materials, and fine chemicals such as perfumes, medicine, cosmetics and pesticide. The term "flowable composites" as referred to in the resent invention means powdered and granular, or liquid compositions having flowability and includes a liquid product having a high viscosity. Among those, the system of the present invention is preferably applicable to the production of paints. With the system of the present invention, the tanks are also applicable to various chemical reactions as reaction vessels.

The tank transportation system of the present invention wherein the tank itself is suspended from the conveying truck which moves, on the rails, through only limited spaces over and below the floor of each floor, can transfer the tank without disturbance by other facilities such as piping and does not separate processes over all stages as done in the method using a stacker crane. Since the tanks are subjected to operation at stations while being suspended and held thereby, operations from both upper and lower stages can be done easily. Furthermore, there are no restrictions with respect to mixed working for tanks having different capacities, the height of working stage and so on. Since the tanks do not move on the floor of the first floor, the floor can be used effectively for setting incidental facilities.

According to the present invention, there is provided a transportation system, comprising at least rails, stations set along the rails and a conveying truck which can, while suspending the tank, move on the rails under computer control and deliver and/or receive the tank at the stations. When such a tank transportation system is applied to various production processes, the change-over of product type can be readily conducted without contamination due to connection work of fixed-pipes and like works, which improves freedom of the production processes. Accordingly, it becomes possible to carry out more suitably multiproduct small-quantity production of flowable composites such as paints.

The tank transportation system of the present invention requires only limited spaces over and below the floor of each floor for movement of the conveying truck suspending the tank. Therefore, it becomes possible to provide incidental facilities on the floor of the first floor and to constitute a rational system through combination of such incidental facilities with the tank, stations, and other incidental facilities on the second floor. The processes throughout each floor are not separated by the tank transportation means, so that the entire facility provides good workability and the space can be used more efficiently. Thanks to this, the plant can be substantially compact. The tank is suspended and held at stations provided near above the floor of each floor and is operated in accordance with predetermined procedures, which affords high workability in operations from both of its upper and lower places. The operations are not separated by the floor of each floor and, therefore, the related facilities on both upper and lower stages can be constituted organically.

According to the present invention, the conveying truck moves, while holding a relatively upper part of the side wall of the tank, so that the tank an move with its center of gravity maintained at a lower position and therefore its contents are shaken only slightly, which is advantageous. Since the tank moves while being suspended by the truck and retained, and is operated in accordance with predetermined procedures at the stations, while being suspended and held thereby, the workability is not substantially impaired necessity of adding a special system even when the tanks having different capacity are involved. For the same reason as the above, the height of the floor above which the tank is suspended can be settled freely, which secures enough space to set incidental facilities.

What is claimed is:

1. A tank transportation system used for producing flowable composites, the tank transportation system comprising:

a conveying truck suspended and movably mounted on rails so as to be movable on the rails between a plurality of stations provided adjacent to said rails;

a movable tank comprising a tank body with a tank supporting base integrated on a side wall of the tank body, said conveying truck comprising means for receiving and suspending the movable tank by supporting the tank supporting base;

first means for moving the movable tank to a position below said suspended conveying truck so as to be suspended from said suspended conveying truck; and second means for moving the conveying truck with the tank suspended thereon based on a procedure pre-set by a computer program to deliver the tank to said stations to perform a prescribed operation at each of said stations.

2. A tank transportation system according to claim 1, wherein said flowable composites comprise paint.

3. A method for producing flowable composites utilizing a tank transportation system, which includes at least processes of receiving raw materials, stirring the received raw materials, delivering produced products and washing a movable tank at a plurality of stations, the method comprising the steps of:

suspending a conveying truck on rails so as to be movable on the rails between stations provided n at least one side of said rails;

conveying a movable tank to a position below said suspended conveying truck and suspending the movable tank on said conveying truck, said movable tank comprising a tank body with a tank supporting base integrate on a side wall of the tank body, such that said conveying truck suspends the tank by supporting the tank supporting base;

moving said conveying truck with said tank suspended thereon on the rails while following a procedure pre-set by a computer program to deliver the tank to one of said stations;

performing a prescribed operation at said one station; and transporting the tank to a next station for a further operation.

4. A method for producing paints utilizing a tank transportation system, which includes at least processes of receiving raw materials, stirring the received raw materials, delivering produced products and washing a movable tank at a plurality of stations, the method comprising the steps of:

suspending a conveying truck on rails so as to be movable on said rails between stations provided on at least one side of said rails;

conveying a movable tank to a position below said suspended conveying truck and suspending the movable tank on said conveying truck, said movable tank comprising a tank body with a tank supporting base integrated on a side wall of the tank body, such that said conveying truck suspends the tank by supporting the tank supporting base;

moving said conveying truck with said tank suspended thereon on the rails while following procedure pre-set by a computer program to deliver the tank to one of said stations;

performing a prescribed operation at said one station; and transporting the tank to a next station for a further operation.

* * * * *